US005562493A

United States Patent [19]

Ferrill et al.

[11] Patent Number: 5,562,493

[45] Date of Patent: Oct. 8, 1996

[54] NETWORK INTERFACE ASSEMBLY AND MOUNTING FRAME

[75] Inventors: Jess B. Ferrill, Madison; Mitchell E. Miller, Clemmons; Terry L. Pitts, Greensboro, all of N.C.

[73] Assignee: The Whitaker, Wilmington, Del.

[21] Appl. No.: 357,816

[22] Filed: Dec. 16, 1994

[51] Int. Cl.[6] ..... H01R 13/60

[52] U.S. Cl. ..... 439/536; 439/539; 439/540.1

[58] Field of Search ..... 439/535, 536, 439/539, 540

[56] References Cited

U.S. PATENT DOCUMENTS

| | | | |
|---|---|---|---|
| 4,725,249 | 2/1988 | Blackwood et al. | 439/535 |
| 4,756,695 | 7/1988 | Lane et al. | 439/76 |
| 4,986,779 | 1/1991 | Ferrill et al. | 439/108 |
| 5,007,860 | 4/1991 | Robinson et al. | 439/540 |

OTHER PUBLICATIONS

AMP Instruction Sheet IS 3207; Feb. 1 1989.
AMP Data Sheets and Drawings for AMP Communications Outlet; 10 Sheets.

*Primary Examiner*—David L. Pirlot
*Assistant Examiner*—Brian J. Biggi

[57] ABSTRACT

An assembly for use in connecting data communications equipment to a data communications network includes a network wiring connector 2, mating modular network connector receptacle inserts 4, a cover 6 and a mounting frame 10. The mounting frame 10 is a one piece member, preferably stamped and formed from a flat metal blank. The mounting frame 10 has a flat rear panel 12 with slots 14 in which the wiring connector 2 is mounted. The insert 4 is an edge card member with a connector interface or receptacle 62 which is aligned with openings 72 in the cover to provide an accessible mating interface for a plug attached to the data communications equipment. Side supports 22 on the mounting frame 10 extend forward to support the front end of the insert 4 and provide latching engagement surface 26 cooperative with snap latches 74 on the insert 4. Frame mounting arms having intermediate sections 16 and distal mounting flange sections 18, 20 extend from the top and bottom of the central rear panel section 12. The frame 10 and the entire assembly can be mounted in a standard wall box.

21 Claims, 9 Drawing Sheets

8
10
14
14
36
64
36
64
36
64
36
64
10
14
14

NETWORK INTERFACE ASSEMBLY AND MOUNTING FRAME

BACKGROUND OF THE INVENTION

1. Field of the Invention

This invention relates to apparatus which is preferably used as part of a data communications network, such as a local area network installed in a building, or as part of a telephone distribution system. More specifically, the subject matter disclosed and claimed herein relates to an accessible network interface assembly or a network outlet which provides a connection point for data communications equipment. A frame or strap is used to mount wiring connectors and network inserts or adapters for connection to electrical connectors on data communications or data terminal equipment. These components can be mounted in a standard wall box or in a wiring closet patch panel.

2. Description of the Prior Art

Data communications networks, such as local area networks used in offices, campuses, and factories require that a large amount of data communications wiring be deployed. Quite often the data communications equipment or data terminal equipment which is used in these networks can change during the life of the facility. However, the wiring installed in the facility can often be used with different types of equipment.

One data communications network interface assembly or data communications outlet assembly which can provide a flexible interface between the installed wiring and various types of communications equipment is disclosed in U.S. Pat. No. 4,756,695. A complementary interface device is disclosed in U.S. Pat. No. 4,986,779. The devices and assemblies disclosed therein each employ a molded plastic frame which can be mounted in a standard wall box or in a wiring closet patch panel assembly. Network wiring connectors and network connector receptacle inserts or adapters can be mounted in these frames to attach the installed wiring to a plug or connector on the communications equipment. The network wiring connectors provide a common interface to shielded twisted pair and unshielded twisted pair data wiring. The network connector receptacle inserts are matable with the network wiring connectors and a family of these inserts provide a number of different receptacle configurations to the data communications equipment. For example, these receptacle configurations include hermaphroditic token ring mating receptacles, modular jack, balun and RS-232 interfaces. These mounting frames also permit coaxial bulkhead connections to be made to bulkhead inserts or adapters which connect directly to coaxial wiring in the wall without the use of the network wiring connector used with discrete wire. Fiber optic assemblies using the same mounting frame are also available.

These mounting frames provide multiple open-ended cavities in which multiple devices, even using different types of wiring, can be installed at a single location, such as in a standard wall box or in a wiring closet patch panel. These mounting frames are integrally molded plastic members with four side walls surrounding the open-ended cavities. Latches and device support members are integrally molded on the walls. The network wiring connectors used in those configurations employ insulation displacement connector terminals to provide for simple field termination of data wires. The network wiring connectors are edge card connectors with a forwardly facing printed circuit board mating interface, and the network connector receptacle inserts have a printed circuit board interface for mating with these edge card connectors. Thus the edge cards can be easily inserted and removed from their mating configuration with the wiring connector, from the mounting frame and from the assembly. The frame also includes screw holes which permit the attachment of a cover to the assembly. The cover includes openings through which the receptacle interface is accessible. The mounting frame also can be plated to provide a shield for applications requiring the use of shielded cable.

An alternative mounting frame configuration is disclosed in U.S. Pat. No. 4,725,249.

Other conventional network wiring assemblies are also available. For example raceways can be employed to distribute the network wiring. The prior art mounting frame and inserts previously described can be used in surface mount boxes with these raceways. Access floor boxes in which these assemblies can be mounted are also available.

SUMMARY OF THE INVENTION

A mounting frame is used to mount a network wiring connector, a network connector receptacle insert and a cover plate for use in attaching a data communications device to a data communications network. In the preferred embodiment of this invention the mounting frame is a one piece member stamped and formed from a flat metal blank. In other embodiments, this mounting frame can also be molded.

The network wiring connector can be mounted in a slot on a flat rear panel of the mounting frame. The network wiring connector has terminals at its rear end which can be attached to the network wiring and a mating interface at its forward end. The mounting frame has a slot in which the network wiring connector is mounted with the rear end attached to the network wiring being positioned on the rear of the mounting frame and the mating interface being on the front of the mounting frame. The slot in the mounting frame is located on a flat back panel. The network wiring connector has a snap latch which engages a surface along one edge of the slot to secure the network wiring connector to the mounting frame. A surface projects adjacent one edge of the slot to support the network wiring connector in the slot. The network connector receptacle insert is mated to the network wiring connector which is located on the front of the mounting frame back panel. Frame mounting arms extend from the top and bottom of the preferred embodiment so that the mounting frame and the assembly mounted on the frame can be secured in place. In the preferred embodiment, these frame mounting arms include mounting flanges at their distal ends which are configured so that the assembly can be mounted in a standard wall box.

The mounting frame also includes cover mounting arms which extend forward from the back panel so that a cover can be mounted on the front of the assembly. In the preferred embodiment depicted herein, the mounting frame also includes network connector receptacle insert support arms extending from the back panel which support the insert adjacent the front of the assembly. These support arms can also include latching surfaces which can engage snap latches on the insert to secure the insert to the frame. The support arms position the insert so that a receptacle at the front of the assembly can be positioned in alignment with openings in the cover. These receptacles at the front of the assembly provide a mating interface to which a connector on the data communications equipment or data communications terminals can be mated. Different network connector receptacle inserts can be inserted into this assembly after the mounting flange is attached in the wall box or in a patch panel so that a receptacle configured for the specific types of data communications equipment can be employed.

Although this assembly and the mounting frame according to this invention can be used with a single position configuration, the preferred embodiment is a dual configuration which can permit the interconnection of at least two different types of data communications equipment at the same location.

This mounting frame also provides a relatively inexpensive mounting device for conventional, commercially available, network wiring connectors and network connector receptacle inserts for those applications which do not require shielding. Stamping and forming is a relatively inexpensive manufacturing method. For a molded plastic configuration, the mounting frame of the preferred embodiment will require less material and a faster mold cycle time than can be achieved with the conventional mounting frames which could be replaced by this frame configuration.

The mounting frame also can be mounted in standard wall boxes. Wall box configurations used in commercial and residential installations are standardized, but there are a large number of different types of these wall boxes. The standard wall boxes that are used in the United States meet the requirements of the National Electric Code and specific common dimensions are standardized by the National Electrical Manufacturers Association (NEMA). The mounting frame of the preferred embodiment fits all standard rectangular wall boxes recognized by NEMA. This mounting frame configuration can be used with standard metal and plastic boxes. This mounting frame configuration can also be used with single, dual and other multiple device boxes as well as gangable boxes. This mounting frame can also be used with two piece boxes, such as shallow boxes to which a mud ring, or plaster ring or tile ring is attached to permit either more space in the device box than would be dictated by the size of the opening or permit the use of wall coverings, such as plaster or mud, which are applied around the box after it has been mounted.

The one piece mounting frame of this invention also can be mounted in a device box is the same manner as a wiring device, such as a switch or duplex receptacle, this making installation more familiar to technicians and eliminating potential field problems.

DESCRIPTION OF THE PREFERRED EMBODIMENT

Figure 1:
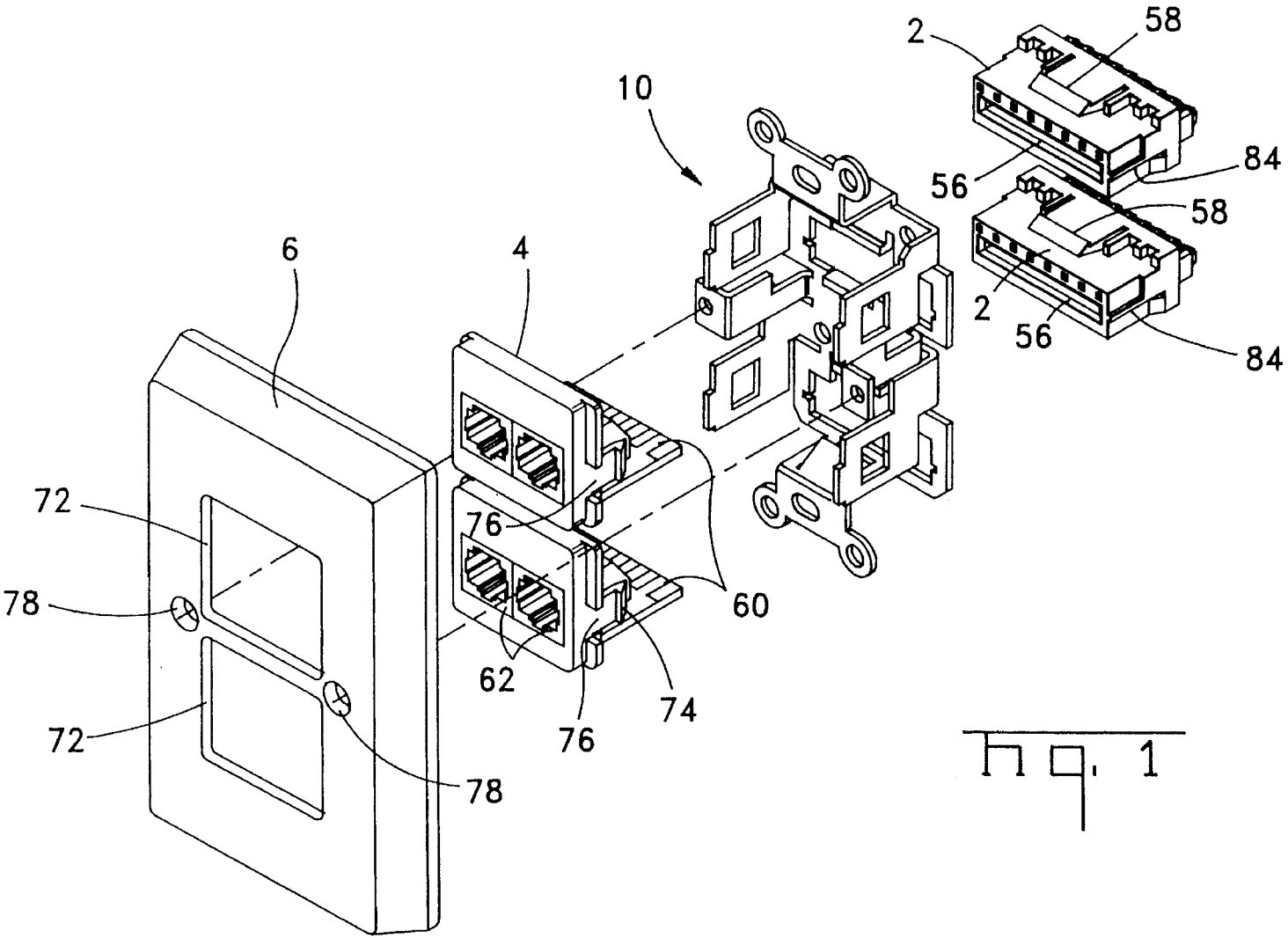
FIG. 1 is an exploded perspective view of the major components of the network interface assembly of data communications outlet assembly, representative of the preferred embodiment of this invention.
Figure 2:
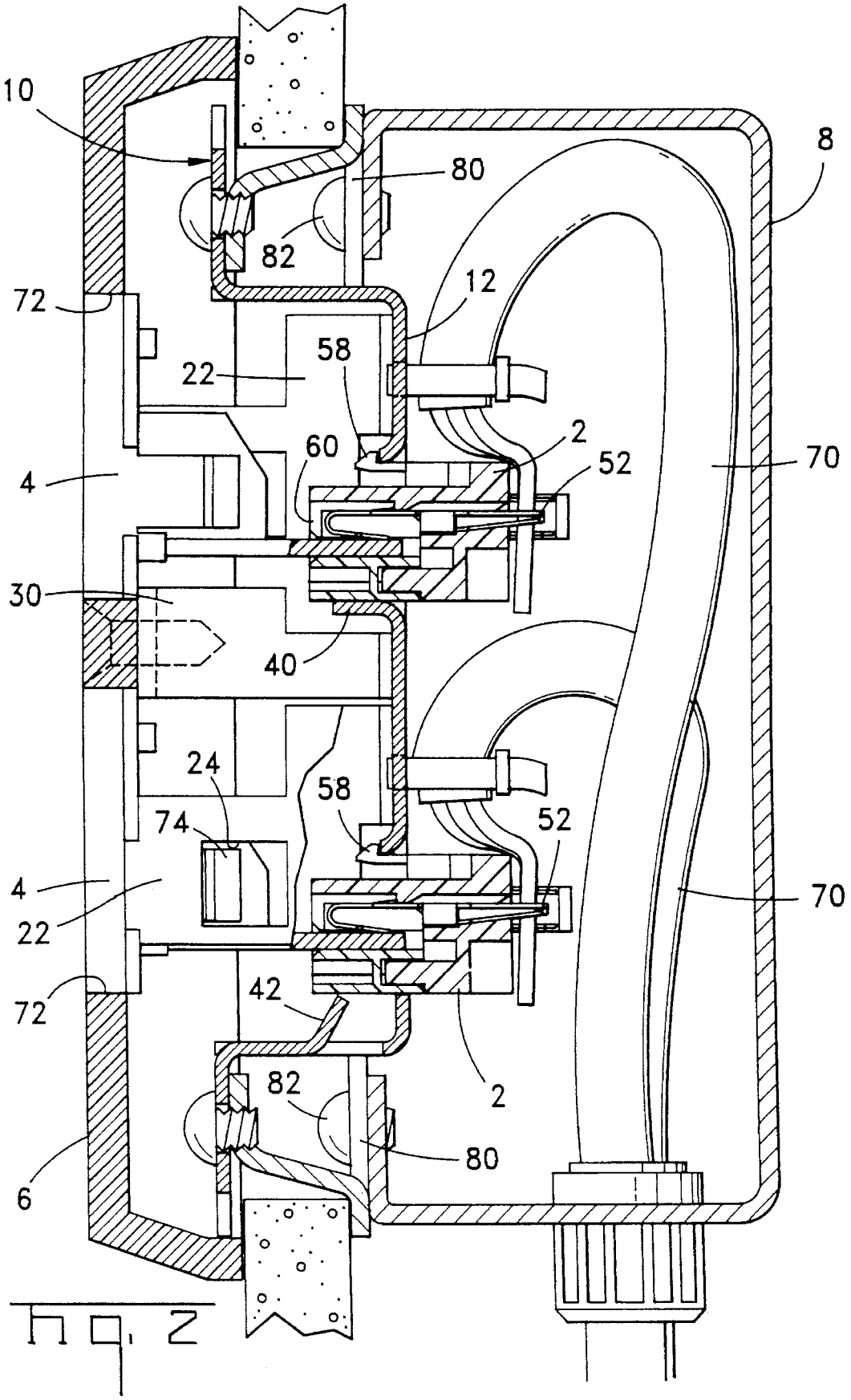
FIG. 2 is a side view, partially in section, showing the components of the network interface assembly mounted in a standard wall box.

The major components of the preferred embodiment of the accessible data communications interface or data communications outlet are depicted in the exploded perspective view of FIG. 1. Two network wiring connectors 2 are employed with two mating network connector receptacle inserts 4. A cover 6 can be mounted to the front with the receptacles in inserts 4 being accessible through openings in the cover. These components can be mounted on frame 10 which can be used to mount the assembly in any of a number of standard wall boxes. A standard two piece wall box 8 is shown in FIG. 2. The wall box shown in FIG. 2 includes a mud ring or plaster ring or tile ring. Other standard wall boxes, such as plastic or metal or gangable metal boxes can be used. The mounting frame can also be used to mount the assembly in a wiring closet patch panel. As can be seen in FIGS. 1 and 2, the network wiring connectors 2 can be inserted into the mounting frame 10 from the rear and the network connector receptacle inserts 4 can be mated with the network wiring connectors by inserting them from the front of the mounting frame 10.

The network wiring connector 2 is a conventional commercially available product. One version of this connector is a printed circuit board edge card connector shown in U.S. Pat. No. 4,756,695. This connector includes insulation displacement terminals at its rearward end. These barrel terminals establish an electrical contact with the conductive core of an insulated wire when the wire is inserted into a terminal slot formed by two opposed terminal edges. Plastic covers which force the wires into the slots are employed. Alternatively similar edge card connectors using insulation displacement terminals which accommodate commercially available Krone and AT&T impact tools can be employed. An edge connector employing terminals 52 of this type is depicted in FIG. 2. It should be understood however that the precise structure of the wiring connector terminals is not considered to be a part of the subject matter of the invention disclosed herein. The terminals 52 include conventional printed circuit board edge card contact sections at the forward end of the terminals. These contact sections engage pads on printed circuit boards inserted into a card edge slot on the forward mating interface of the network wiring connector 2. This card edge slot comprises the mating interface of the connector 2. Ribs 84 are located on the sides of this conventional connector. These ribs provide a means to position the connector 2.

The network connector receptacle insert 4 depicted herein is also a conventional component, and one example of this insert is shown in more detail in U.S. Pat. No. 4,756,695. The version of the insert 4 depicted herein has dual connector receptacle interfaces 62 at its forward end. The receptacle interface depicted herein is in the form of two keyed modular jack interfaces. This is a conventional interface which is matable with a modular plug, a connector interface which is commonly used on data communications equipment. Other interface configurations may however be used. The insert 4 also includes an insert connector interface 60, here in the form of pads on the edge of a small printed circuit board, which mates with the network wiring connector 2. Traces on the printed circuit board join the pads at the insert interface 60 with terminals in the connector interface 62 so that when the insert 4 is mated with wiring connector 2, corresponding lines in the network wiring 70 are interconnected with the appropriate lines at the insert connector interface 62. The conventional inserts 4 also include insert snap latches 74 which are described with reference to the assembly depicted in U.S. Pat. No. 4,756,695.

Cover 6 shown in FIG. 1 is representative of conventional covers used on prior art communications assemblies. This cover 6 is similar to the covers used in other applications where standard wall boxes are employed, such as single gang faceplates for electrical wiring. However, this cover has two openings 72 through which the connector interfaces 62 on two inserts 4 are accessible. Cover mounting holes 78 are also provided on the sides of the cover 6. This position for the cover mounting holes does differ from that employed on most standard faceplates. However, prior art communications outlets of this type use the standard screw holes on a standard wall box to mount a mounting frame. The manner in which the cover 6 is mounted on the mounting frame 10 depicted herein will be discussed in greater detail with reference to the subsequent description of the structure of the mounting frame.

The preferred embodiment of the mounting frame 10 is a one piece stamped and formed metal member which mounts the entire data communications interface or outlet assembly to a standard wall box. The preferred embodiment of this mounting frame is stamped and formed from 18 gage steel. It should be understood however, that other materials and thicknesses could be employed and that a frame, encompassing all of the essential elements of the frame depicted herein could also be molded. Minor modifications which would be apparent to one of ordinary skill in the art, such as increasing the thickness of surfaces containing screwholes, would of course be necessary in order to mold a frame of this type. FIG. 2 shows that this frame 10 can be mounted in one of several types of standard wall boxes 8 and shows the manner in which the network wiring connector 2, the network connector receptacle insert 4 and the cover 6 are mounted by the frame. As is apparent from FIG. 2, the mounting frame 10 is in some ways similar to a mounting strap or mounting yoke used for conventional electrical devices. The embodiment of the frame depicted in FIG. 2, as well as elsewhere in this disclosure, is a dual component mounting device. Two network wiring connectors are mounted to the mounting frame 10 with the wiring connector terminals 52 located on the rear of the frame. As is apparent from FIGS. 1 and 2, the network wiring connectors are first attached to the network wiring 70 and inserted into engagement with the mounting frame 10 from the rear. The mating interface of the wiring connectors 2 is located on the front of the mounting frame rear surface and a wiring connector snap latch 58 engages the mounting frame 10 in a manner which will be subsequently discussed in more detail. Two network connector receptacle inserts 4 are mated with corresponding wiring connectors 2 by inserting the inserts 4 into mating engagement with wiring connectors 2 from the front of the mounting frame. Mating inserts 4 to corresponding wiring connector 2 would normally, but not necessarily, occur after the mounting frame is mounted to the wall box 8. The wall box 8 shown in FIG. 2 is intended to represent any standard wall box with which this configuration can be employed. The specific wall box configuration depicted herein is a wall box in which a mud ring, or plaster ring or tile ring 80 is attached to box 8. Screws 82 are used to secure ring 80 to the rear portion of the box. This configuration is shown here to demonstrate that the mounting frame 10 can be used in applications which are more restrictive than would normally be encountered with more widely used one piece boxes used to house one or multiple devices. This configuration can result in a smaller front opening on the box than would otherwise be available with other standard boxes. For example a single opening ring would normally be employed with a dual box in applications in which additional space is needed for a device. Although additional space is not required for this assembly, it may be necessary to use a ring 80 to accommodate the type of wall covering being used in a specific installation. For example the ring 80 could be used to insure that plaster could be applied so that no gap could be seen in the finished installation. A metal box is depicted in FIG. 2, but this mounting frame 10 could also be employed with a conventional plastic box.

Figure 3:
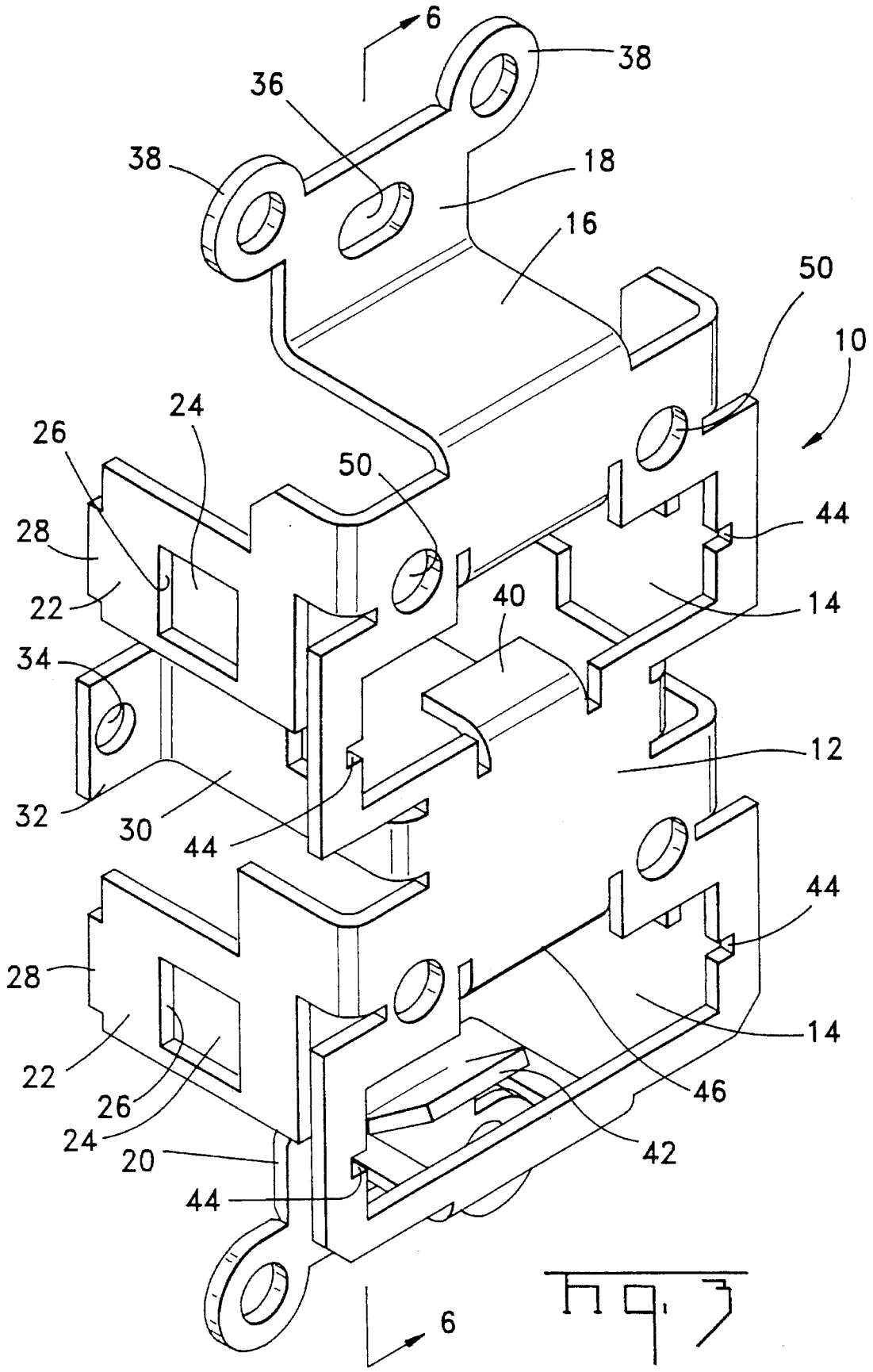
FIG. 3 is perspective view of the mounting frame as viewed from the rear.
Figure 4:
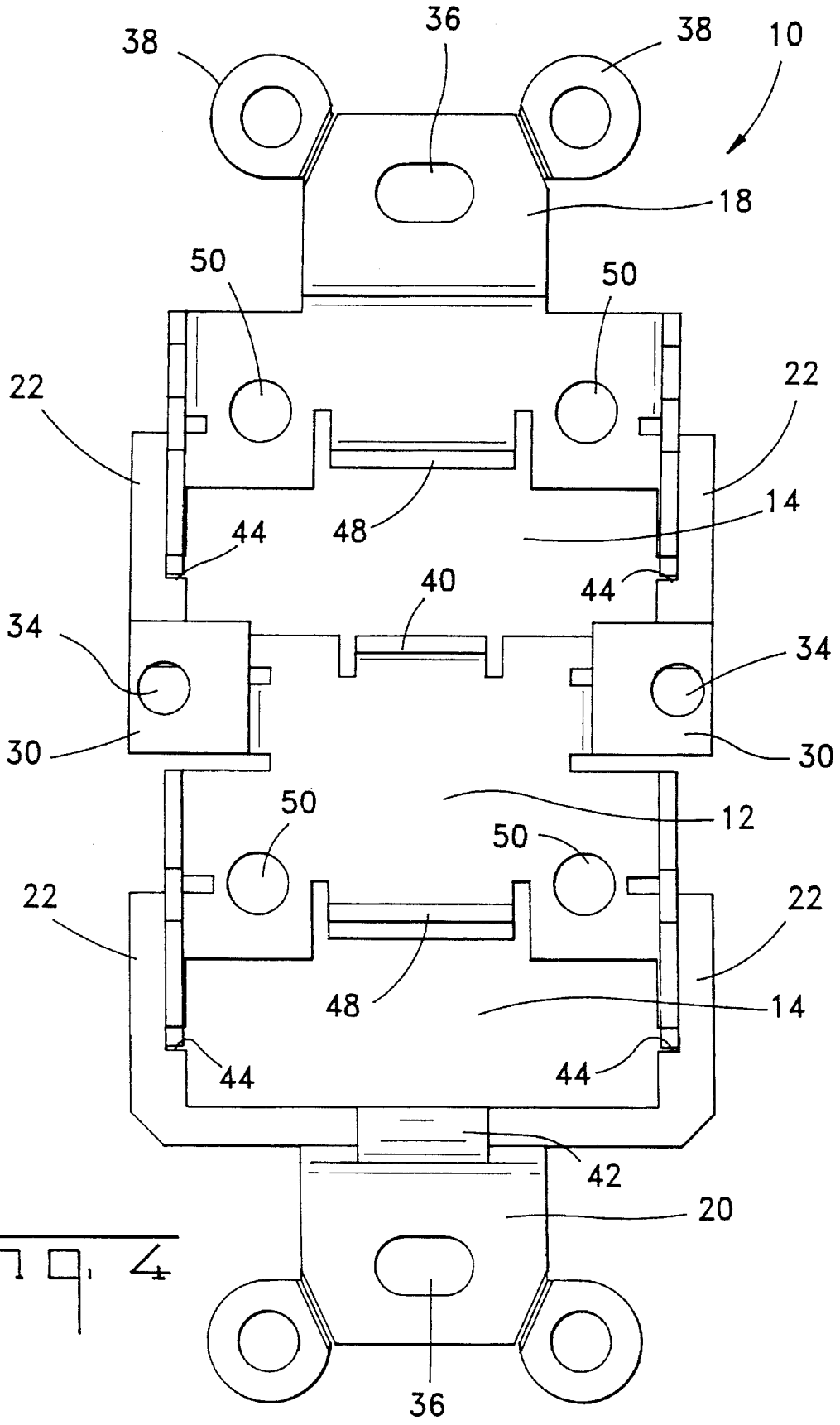
FIG. 4 is a rear view of the mounting frame.
Figure 5:
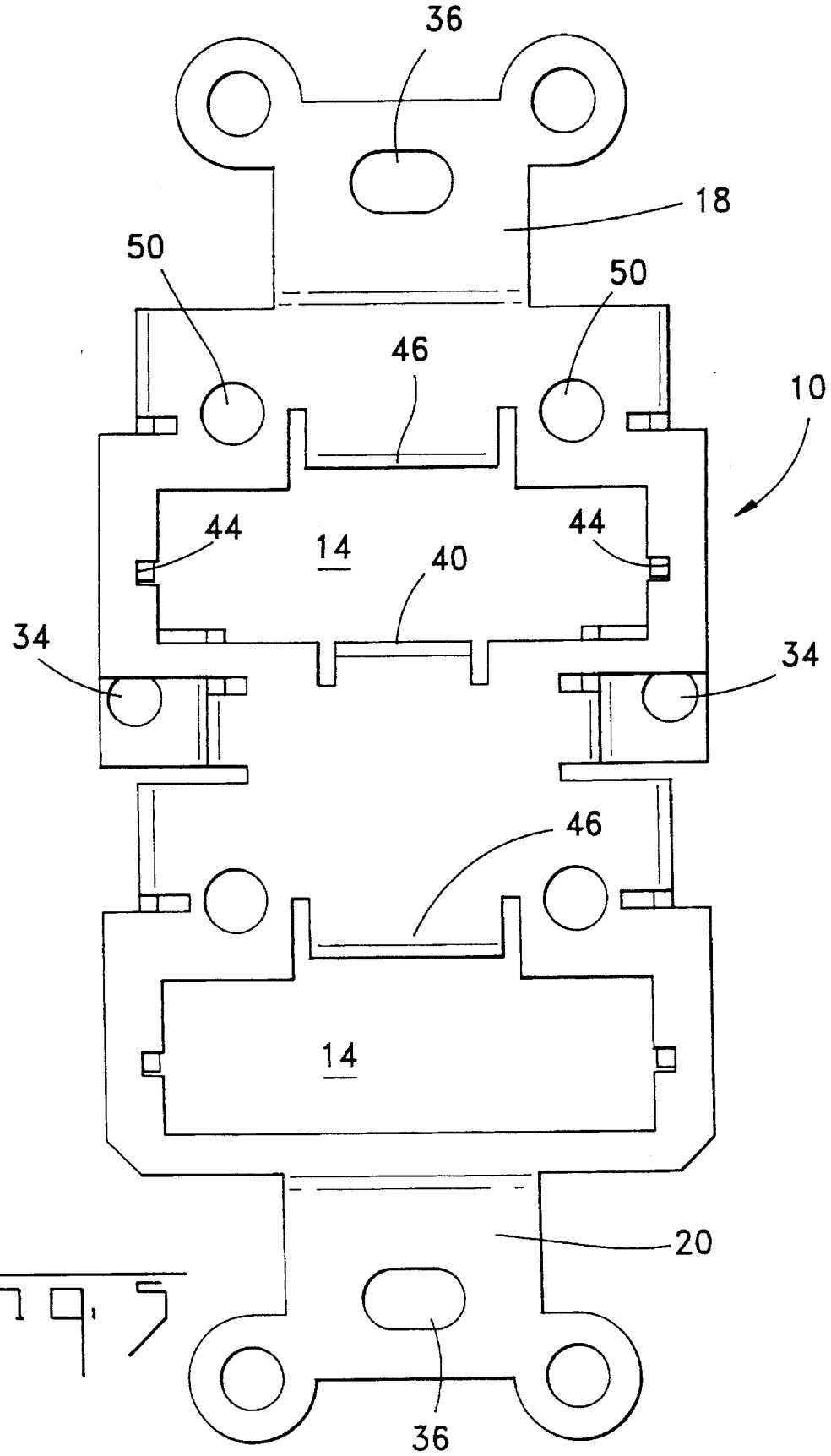
FIG. 5 is a front view of the mounting frame.
Figure 6:
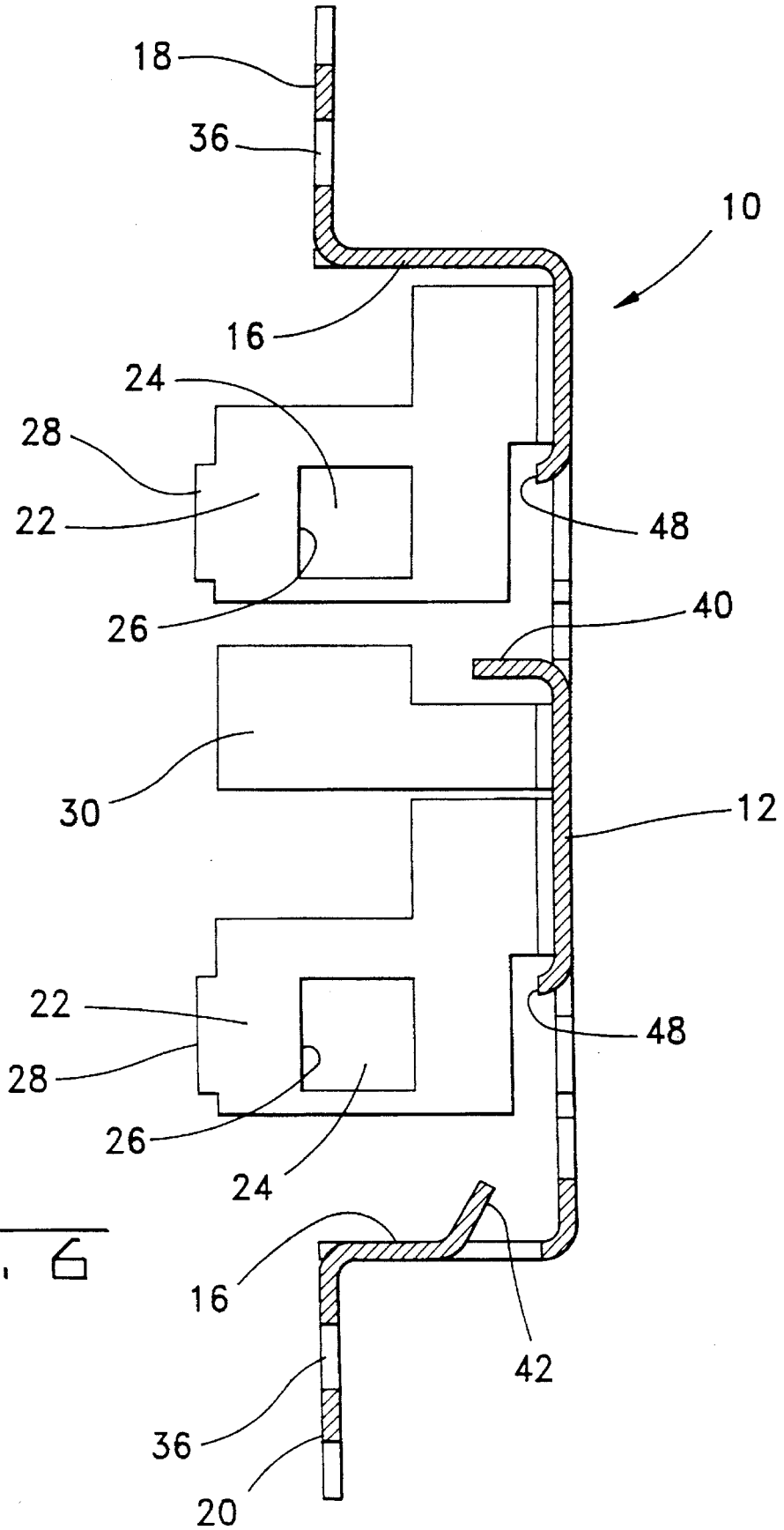
FIG. 6 is a side sectional view of the mounting frame taken along section lines 6—6 in FIG. 3.
Figure 7:
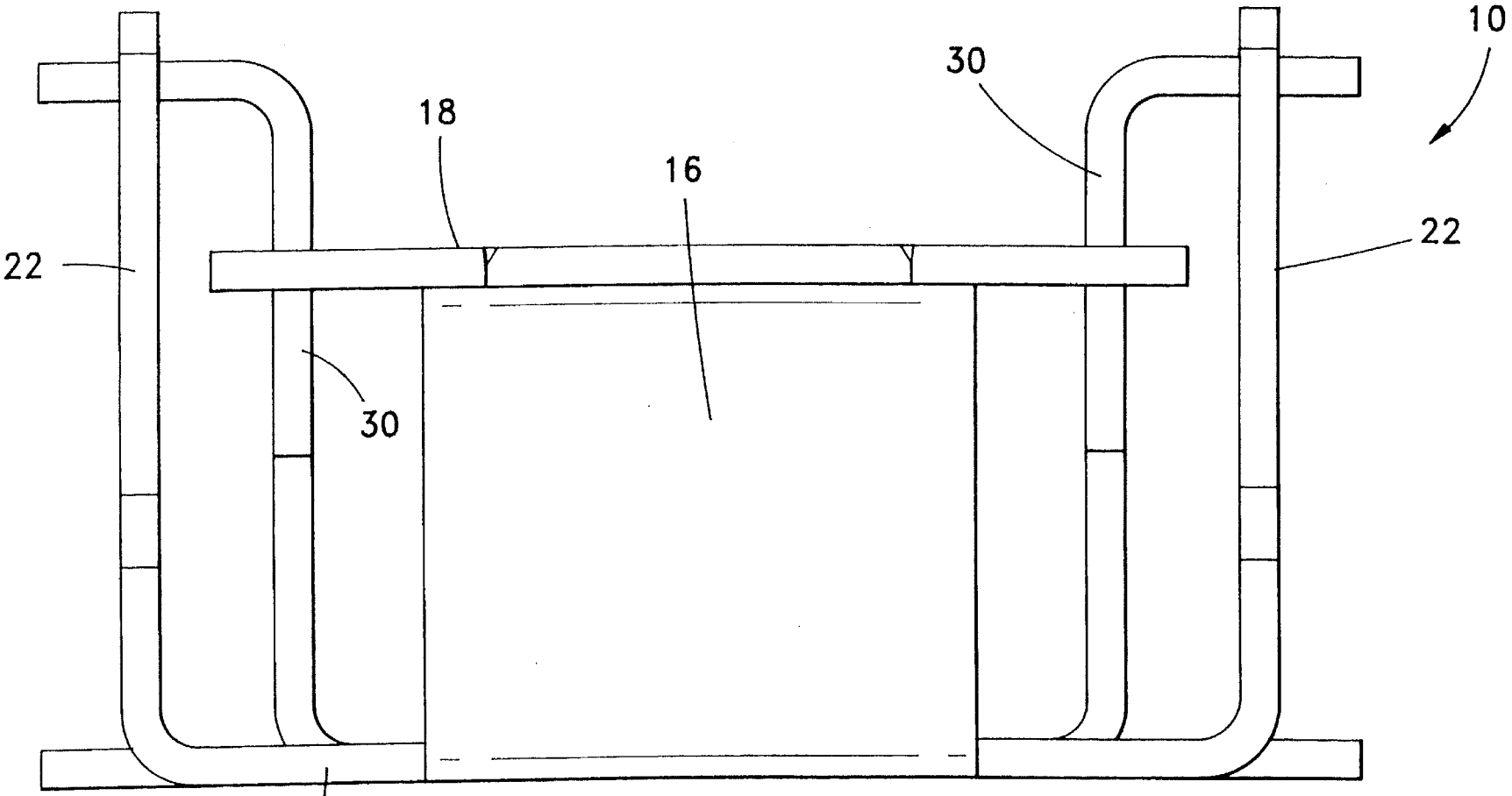
FIG. 7 is a top view of the mounting frame.

FIGS. 3–7 show the details of the stamped and formed mounting frame 10. FIG. 3 is a perspective view in which a rear of the mounting frame is shown. As can be seen, the rear of the mounting frame 10 is a substantially flat panel 12 from which two slots 14 have been stamped by removing material to form these openings. This rear panel or back panel 12 comprises the central strap section of the one piece frame 10. Each of the two slots has a groove 44 on both side edges of the slot 14. When a wiring connector 2 is inserted into a slot 14, the side ribs 84 on the wiring connector 2 fit in grooves 44 to properly position the wiring connector 2.

A projection 40 is formed on the lower edge of the upper slot 14 as shown in FIG. 3. This projection 40 extends forward of the plane of the back panel 12 (to the rear as viewed in FIG. 3, but toward the front end of the mounting frame 10 as the device is actually employed). This projection 40 forms a lower support surface for a wiring connector 2 inserted in the upper slot 14. The lower slot 14 does not have a projection formed from the slot lower edge. However a tab 42 extending from an intermediate section 16 does project upwardly from the intermediate section into alignment with the lower edge of the lower slot 14. Use of a projection similar to projection 40 instead of use of a tab projection 42 in this position would result in a weaker structure. A projecting surface similar to surface 40 could, however, be formed on the lower edge of the lower slot if desired. In any event the tab 42 does provide a lower support surface for a wiring connector 2 located in the lower slot 14.

As can be seen in FIG. 3, tabs are formed on the upper edge of each slot 14. These upper tabs are formed in the same direction as tab projection 40, but, as can be seen most clearly in FIGS. 2 and 6, do not project significantly beyond the forward face of the back panel 12. These upper tabs are bent over to form forwardly facing engaging or latching surfaces 48 which engage the wiring connector snap latch 58 when the wiring connectors 2 are inserted through corresponding slots 14. The snap latches 58 engage surfaces or edges 48 to secure the wiring connector to the back panel 12 of the mounting frame 10. When the inserts 4 are mated with wiring connectors 2, this snap latch engagement prevents the wiring connector 2 from being forced rearwardly out of the slot 14. Since the snap latch on these conventional wiring connectors 2 is deflectable, the wiring connector 2 can be removed by depressing the snap latch so that it clears the engagement surface 48.

The rear flat panel 12 of mounting frame 10 also includes two holes 50 adjacent each of the slots 14. These holes 50 are dimensioned so that standard wire ties can be inserted to secure the network wiring 70 to the rear of the mounting frame 10.

Frame mounting arms are formed by intermediate strap sections 16 and top and bottom strap sections 18,20. These intermediate strap sections 16 are joined to the top and bottom of the rear panel 12 and extend transversely of the flat back panel 12 toward the front of the mounting frame 10 (to the rear as viewed in FIG. 3). Frame mounting sections or mounting flanges 18, 20 are joined to the intermediate sections 16 at the distal ends of the mounting frame 10. These mounting flanges are formed transversely relative to the intermediate sections 16 so that they are substantially parallel to the rear panel 12. These mounting flanges are similar in configuration to the mounting strap sections found on conventional electrical device mounting yokes or straps mounted in standard wall boxes. Each mounting flange contains a mounting hole 36 which is positioned to be in general alignment with the wall box mounting or screw holes 64 in a standard device box. These holes 36 are oblong so that the mounting frame can be rotated relative to the device box so that the mounting strap or frame 10, and the entire assembly can be straightened, since wall boxes are not usually precisely vertically oriented. Mounting flanges 18, 20 also have conventional mounting ears 38. A break line can be formed at the base of the mounting ears 38 so that these ears can be broken off in some applications.

While the wiring connectors 2 are positioned in slots 14 and latched to the rear panel 12 of the mounting frame 10, the network connector receptacle inserts 4 are supported by network connector receptacle insert support members or arms 22 which extend transversely forward relative to the rear panel 12. In the preferred embodiment, four of these arms 22 extend from the sides of the rear panel. Two support arms 22 are adjacent each slot 14. In the preferred embodiment, the support arms 22 join the rear panel 12 in the section of the rear panel between the two slots 14. The width of these support arms is greater in the portion extending forward of the rear panel 12 then at the point where they join the rear panel. These support arms are wide enough to be said to form walls on either side of the inserts 4 when positioned in mating engagement with the wiring connectors 2.

A tongue 28 is formed on the distal end of each of the support arms 22. The height of this tongue is dimensioned so that the tongue will engage a keyslot 76, which can be seen in FIG. 1, on each side of the front face of the conventional network connector receptacle insert 4, so that the support arm 22 supports the front of the insert 4. Each support arm or wall 22 also has an opening 24 in front of the rear panel 12 on the mounting frame 10, and to the rear of the support arm distal end. The opening 24 is dimensioned so that when the corresponding insert 4 is properly mated with a wiring connector 2, the flexible snap latch 74 on the insert 4 will be received within the opening 24. The snap latch 74 is then positioned so that it will engage a support arm latching surface 26, which comprises the front edge of the opening 24. This engagement prevents inadvertent removal of the insert 4 such as when a cord attached to the data communications plug is pulled. Note that this support arm and the tongue 74 and latch opening 24 can be used to support an insert 4 which does not mate with a wiring connector 2. For example, a coax bulkhead insert can be positioned in the mounting frame, in which case there is no need for the wiring connector 2 since the coaxial cable behind the wall connects directly to a female to female coaxial connector on the insert.

A cover plate mounting support or cover mounting arm 30 extends from each side of the rear panel 12 between upper and lower network connector receptacle insert support arms 22. This cover mounting arm 30 is centrally located and extends transversely forward parallel to support arms 22. A cover mounting base 32 is located at the distal end of each cover mounting arm 30 and the base is formed transversely relative to the cover mounting arm so that it is substantially parallel with the rear panel 12 and the frame mounting flanges 18, 22. Cover mounting holes 34 are centrally located in each base 32 and these holes are positioned in alignment with the cover mounting holes 78, so that the cover 6 can be attached to the mounting frame.

Figure 8:
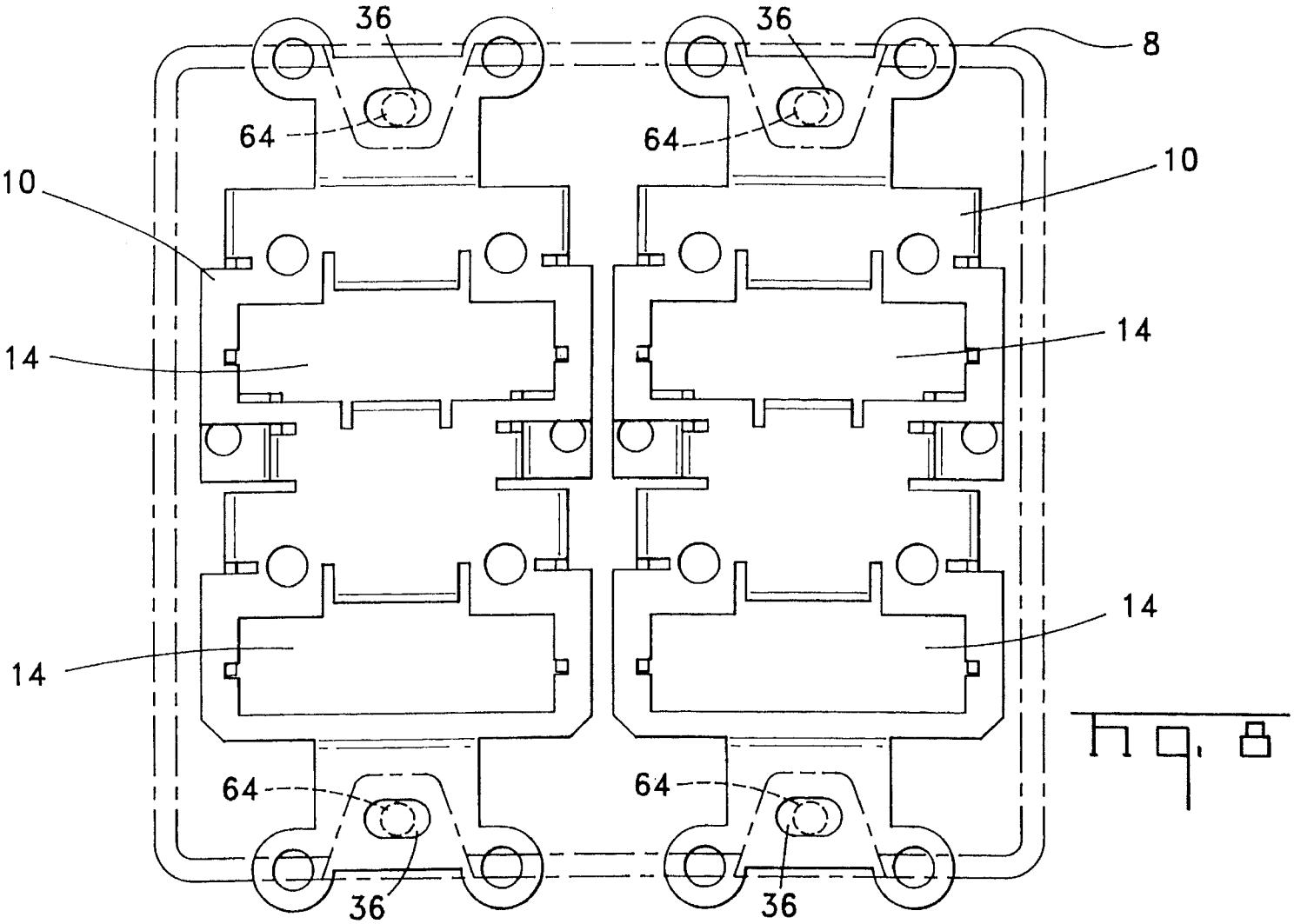
FIG. 8 is a view of two mounting frames is the side by side configuration which they would occupy when two devices are mounted in a dual box.

FIGS. 4–7 are views of the mounting frame 10 from different vantage points and any structure which is not clearly shown in FIG. 3 is shown in those additional views. FIG. 8 depicts one significant requirement which is met by this mounting frame 10. Two mounting frames or straps 10 are shown side by side in a standard dual or dual gang box 8 (shown in,phantom). The width of the frames is such that each frame can be positioned with the frame mounting holes 36 in alignment with screw holes 64 in the dual box. At no point is the width of the frame 10 such that there would be any interference when positioned in this manner.

Figure 9:
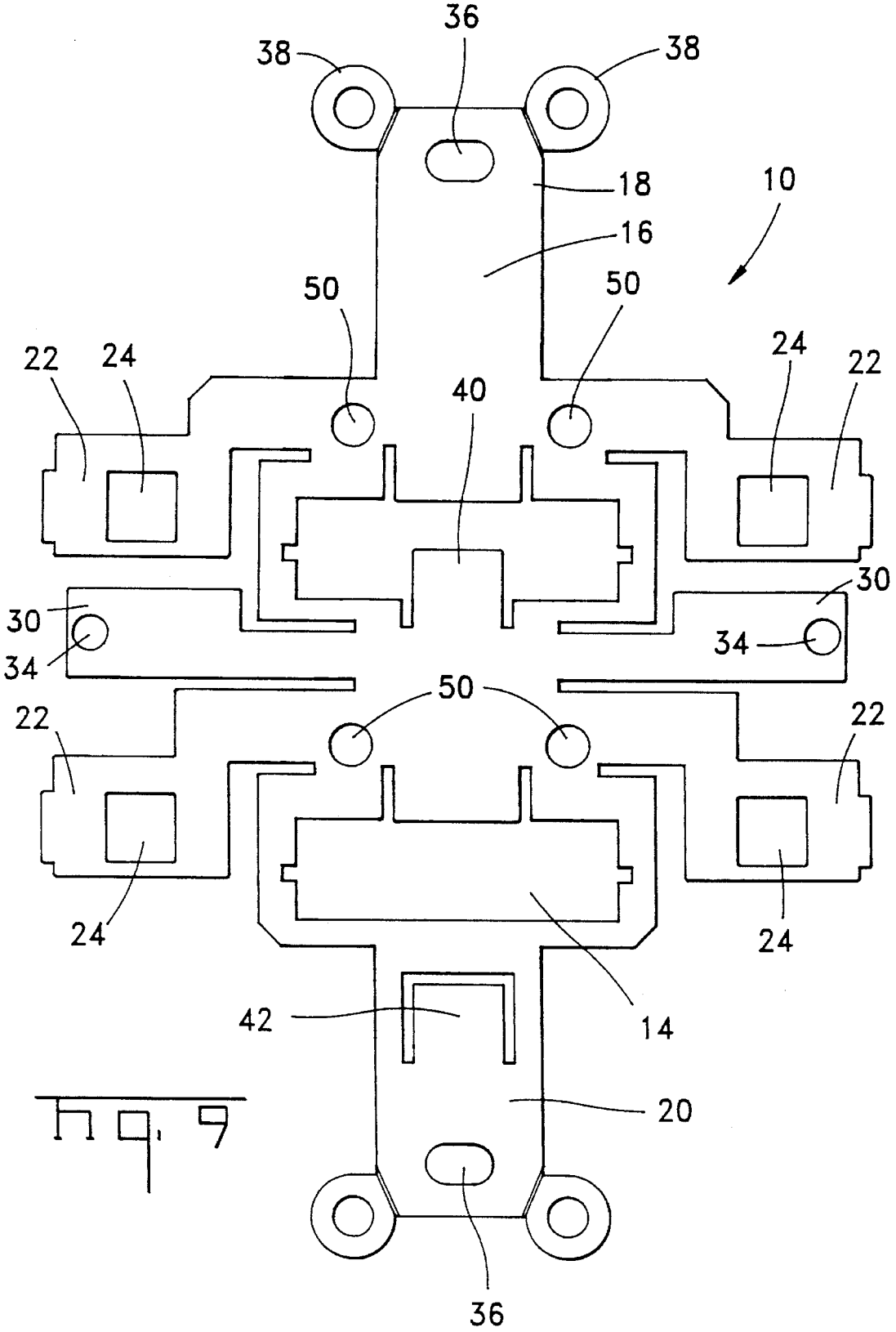
FIG. 9 is a view of the flat stamped blank from which the mounting frame would be formed into the configuration shown in FIGS. 1–8.

FIG. 9 shows the flat blank from which the mounting frame 10 is formed. This figure shows that material has been punched out to define the slots 14 and the various openings 24, 34, 36, and 50. The outline of the mounting arms 16, 18, 20; the support arms 22 and the cover mounting arms 30 is shown.

Although only a single stamped and formed configuration has been depicted as the preferred embodiment, other equivalent structures could be employed in other embodiments. For example it would be possible to form the insert support arms by joining then to the intermediate sections of the frame mounting arms. It would also be possible to form the cover mounting arms using material which is otherwise punched out to form the slots, and while the configuration of the slots would no longer conform to the shape of the wiring connectors, the mounting frame would still be functional. This mounting frame could also be modified to accept different wiring connectors and inserts without departing from the scope of this invention. These and other similar modifications could be made to this structure without departing from the scope and subject matter defined by the following claims.

We claim:

1. A mounting frame for use in the attachment of a data communications device to a network, the network including a network connector receptacle insert mated to a network wiring connector connected to network wiring; the mounting frame comprising a one-piece member including:

a substantially flat panel having a slot through which the network wiring connector can be inserted so that the network wiring will be located to the rear of the panel and so that the network connector receptacle insert can be mated to the network wiring connector on the front of the panel;

a surface on the panel engaging a snap latch on the network wiring connector after the network wiring connector is inserted into the slot;

a projection extending transversely relative to the panel to support a network wiring connector positioned in the slot;

a frame mounting arm extending transversely forward relative to the panel; and a cover mounting arm extending transversely forward relative to the panel.

2. The mounting frame of claim 1 wherein a groove is located on a side of the slot, the groove being configured to receive a rib on the network wiring connector to position the network wiring connector in the slot.

3. The mounting frame of claim 1 wherein the projection extends from the flat panel adjacent the bottom of the slot.

4. The mounting frame of claim 1 wherein the projection extends from the frame mounting arm adjacent the bottom of the slot.

5. The mounting frame of claim 1 wherein frame mounting arms extend from the top and bottom of the panel.

6. The mounting frame of claim 5 wherein each of the frame mounting arms includes a mounting flange at its distal end, the mounting flange including a screw hole positioned for alignment with screw holes in a standard wall box.

7. The mounting frame of claim 1 further including a network connector receptacle insert support arm extending transversely forward relative to the panel.

8. The mounting frame of claim 7 wherein the support arm distal end engages the network connector receptacle insert when the network connector receptacle insert is mated with the network wiring connector.

9. The mounting frame of claim 8 wherein the support arm includes a latching surface engaging the network connector receptacle insert when mated with the network wiring connector.

10. The mounting frame of claim 9 wherein the latching surface comprises an edge of an opening in the support arm.

11. The mounting frame of claim 1 further including two holes in the panel adjacent the slots, the holes being large enough for insertion of wire ties to secure the network wiring to the mounting frame.

12. The mounting frame of claim 1 wherein two slots are located in the panel, one slot adjacent the top of the panel and the other slot adjacent the bottom of the panel, and frame mounting arms extending from the top and bottom of the panel.

13. The mounting frame of claim 12 wherein one projection extends from the flat panel adjacent the top slot and one projection extends from the bottom frame mounting arm adjacent the bottom slot.

14. The mounting frame of claim 12 wherein cover mounting arms extend from opposite sides of the panel between the two slots.

15. The mounting frame of claim 14 wherein network connector receptacle insert support arms extend from opposite sides of the panel adjacent both slots, the cover mounting arms being located between the support arms on each side of the panel.

16. The mounting frame of claim 1 wherein the mounting frame comprises a one piece member stamped and formed from a flat metal blank.

17. A mounting frame for use in the attachment of a data communications device to a network, the network including a network connector receptacle insert with a receptacle interface at the forward end thereof, connected to network wiring; the mounting frame comprising a one-piece member including:

a substantially flat panel having at least one slot;

a projection extending transversely relative to the panel adjacent the lower edge of each slot:

a frame mounting arm extending transversely forward relative to the panel;

an insert support arm joined to the flat panel and extending forward from the flat panel on each side of each slot, the insert support arm having a protruding section at its forward end for engaging and supporting the network connector receptacle insert, and a latching surface between the rear panel and the forward end to which the insert can be secured: and at least one cover mounting arm extending transversely forward from the rear panel: whereby a cover can be mounted on the cover mounting arm with the connector receptacle on each insert being accessible through an opening on a cover attached to the cover mounting arm.

18. A mounting strap for use in a local area data communications network to mount an accessible network interface subassembly in a standard wall box into which local area data communications network wiring, running behind the wall, extends; wherein the standard device box includes mounting holes at the top and bottom of the wiring device box; and wherein the accessible network interface subassembly comprises two network wiring connectors and two network connector receptacle inserts matable with the network wiring connectors; the mounting strap comprising a one piece metal member stamped and formed from a flat blank including:

strap mounting openings in coplanar top and bottom sections of the mounting strap, the mounting openings being spaced apart for alignment of the strap mounting openings with standard wall box mounting holes so that the mounting strap can be mounted vertically in the standard wall box by screws extending through the strap mounting openings into engagement with the standard wall box when the top and bottom mounting strap sections abut the exterior of the device box;

intermediate strap sections formed transversely relative to the top and bottom sections;

a central strap section joining and extending between the intermediate sections and extending parallel to and rearwardly spaced from the top and bottom strap sections, the intermediate strap sections being formed transversely to the central strap section;

two spaced apart laterally extending slots in the central strap section, the slots being configured for insertion of network wiring connectors into the slots; and network connector receptacle insert support members located on each side of the central strap section and adjoining the central strap section and formed transversely forward from the central strap section toward the coplanar top and top and bottom strap sections.

19. The mounting strap of claim 18 wherein the network connector receptacle insert support members and the intermediate strap sections each adjoin the central strap section but are otherwise not connected to each other.

20. The mounting strap of claim 19 further comprising cover plate mounting supports extending from the central section toward the plane occupied by the top and bottom sections, so that a cover plate can be mounted to the front of the network interface subassembly.

21. The mounting strap of claim 20 wherein the cover plate mounting supports and the network connector receptacle insert supports join the central strap section between the two slots, the cover plate mounting supports being positioned between network connector receptacle insert supports on each side of the central strap section.

* * * * *